US005924147A

United States Patent [19]

Clark et al.

[11] Patent Number: 5,924,147

[45] Date of Patent: Jul. 20, 1999

[54] BATHTUB LIFT

[75] Inventors: Johnny R. Clark, Spokane; Ricky L. Mettler, Greenacres, both of Wash.

[73] Assignee: Safety Bath Corporation, Spokane, Wash.

[21] Appl. No.: 09/017,552

[22] Filed: Feb. 2, 1998

[51] Int. Cl.[6] ..... A47K 3/022

[52] U.S. Cl. ..... 4/562.1

[58] Field of Search ..... 4/560.1–566.1

[56] References Cited

U.S. PATENT DOCUMENTS

| | | | |
|---|---|---|---|
| 2,187,283 | 1/1940 | Scheutz | 4/561.1 X |
| 3,289,217 | 12/1966 | Glover | 4/562.1 |
| 3,435,466 | 4/1969 | Cheney | 4/185 |
| 3,918,108 | 11/1975 | Feyerherm | 4/563.1 |
| 4,628,550 | 12/1986 | Walton | 4/560.1 |

OTHER PUBLICATIONS

Safety Bath Corporation brochure "Cheney Hydraulic Bath Lift Chair," published prior to Dec. 1, 1996.

Photos of "Cheney Hydraulic Bath Lift Chair" on sale prior to Jan. 1, 1997.

*Primary Examiner*—Charles E. Phillips

*Attorney, Agent, or Firm*—Wells, St. John, Roberts, Gregory & Matkin P.S.

[57] ABSTRACT

A portable bathtub lift is described for releasable mounting to a bathtub of the type that includes a tub surround formed by a substantially upright wall extending upwardly from a support surface and terminating at an elevated top ledge surface. The lift includes a frame configured to rest against the support surface outwardly adjacent the upright tub wall and a clamp with a clamp actuator on the frame configured to releasably secure the frame to the bathtub. A lift mechanism on the frame includes a patient support surface that is powered to move the patient support surface elevationally. The patient support surface is pivotable about a substantially vertical axis between a position outward of the tub and a position over the tub.

7 Claims, 6 Drawing Sheets

BATHTUB LIFT

TECHNICAL FIELD

The present invention relates to lifting patients into and out from conventional above surface bathtubs.

BACKGROUND OF THE INVENTION

Power lifting devices have been developed in the past, for assisting entrance and egress from bathtubs. However, most of such units require special bathtub construction, or structural modifications in the area of the tub.

A significant improvement in bathtub lifts is the "Cheney Hydraulic Bath Lift Chair" brand bathtub lift produced by Safety Bath Corp. in Spokane Wash. This lift must be attached to the tub using bolts extending through brackets and into the top ledge of the tub. The lift bolts to the floor adjacent the bathtub in a secure manner, and a hydraulic pump driven by an electric motor is used with appropriate controls to lift a patient into and out from the tub.

The present invention includes still further improvements to the above lift, by increasing the portability of the unit, and through other features that will become apparent from the following detailed description.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

Figure 1:
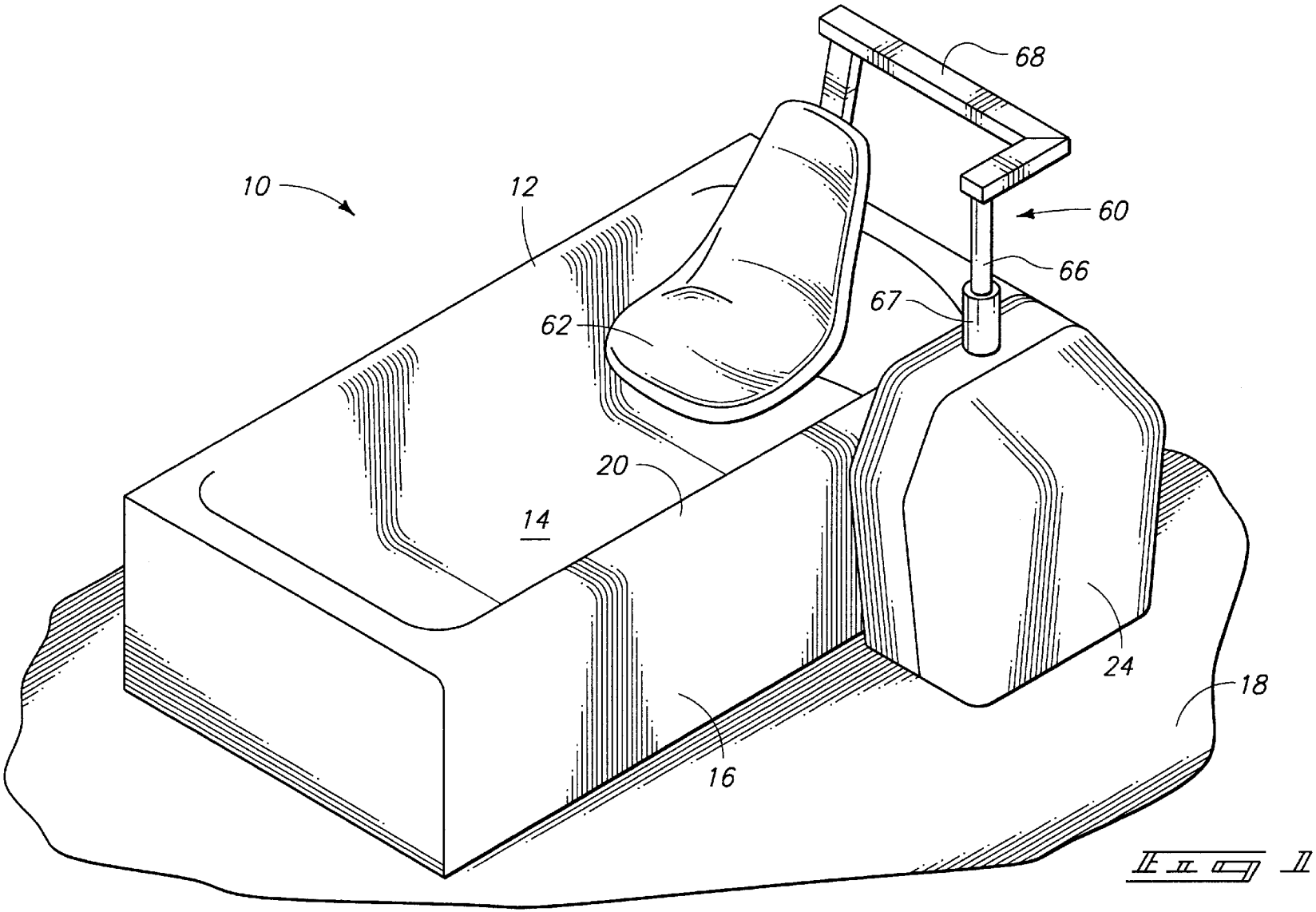
FIG. 1 is a perspective view of a preferred form of the present portable bathtub lift with the chair in place and elevated above a conventional bathtub.

This disclosure of the invention is submitted in furtherance of the constitutional purposes of the U.S. Patent Laws "to promote the progress of science and useful arts" (Article 1, Section 8).

A preferred example of the present portable bathtub lift is generally designated by reference numeral 10 in the accompanying drawings. The lift 10 is provided to be mounted to a conventional bathtub of the type including a tub surround 12 and a tub basin 14 into which water is received for bathing.

In the typical conventional bathtub, the tub surround 12 is formed by a substantially upright rigid wall 16 positioned on a support surface 18. The tub may be any of a variety of conventional, above surface bathtubs in which the tub surround 12 and tub basin 14 rests on and projects upwardly of the support surface 18. The tub wall 16 terminates at an elevated top ledge surface 20 that is typically flat and spans the distance between the wall 16 and the tub basin 14.

Figure 6:
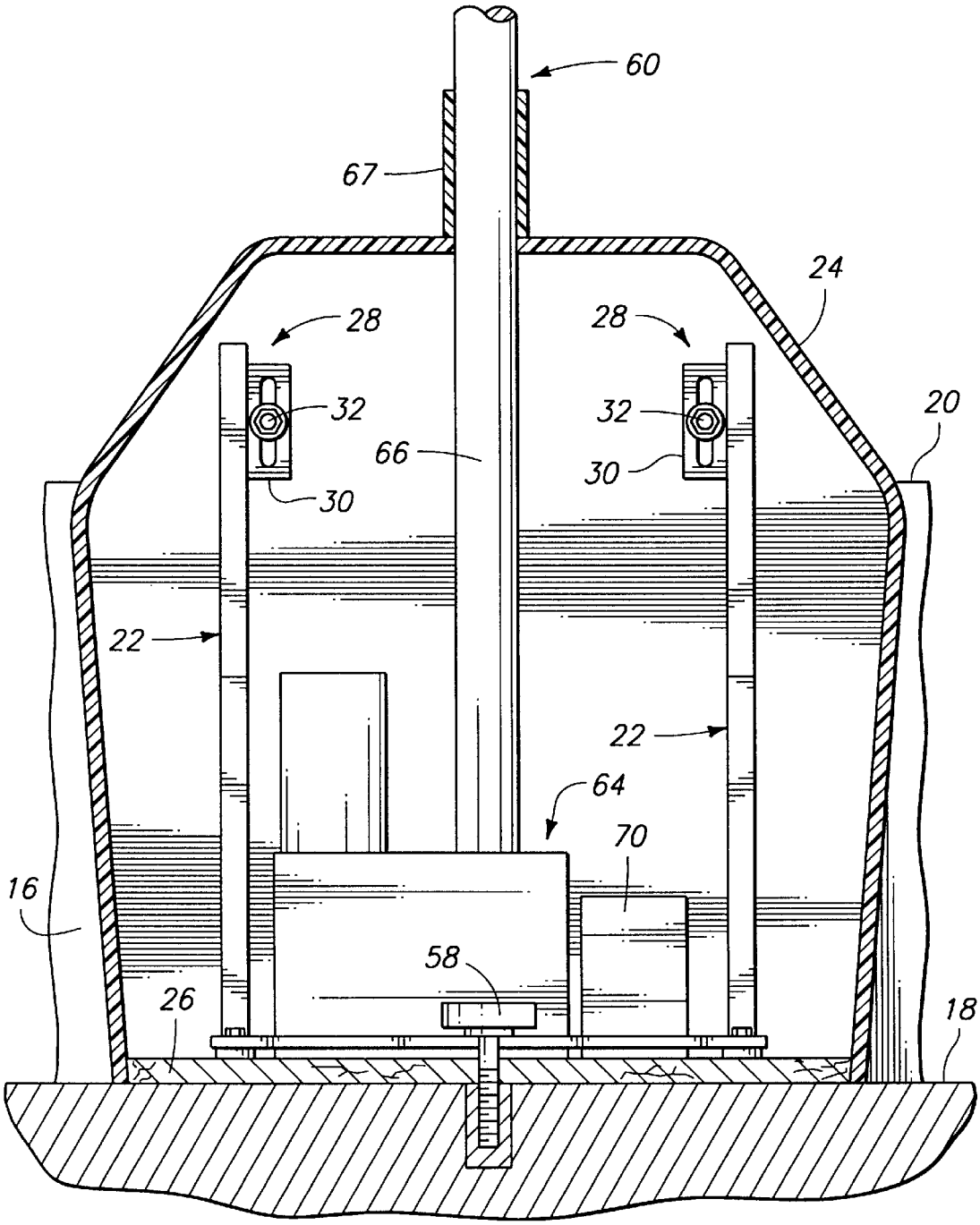
FIG. 6 is an enlarged, fragmented sectional view taken substantially along line 6—6 in FIG. 2.

The preferred lift 10 includes a frame 22 (FIG. 6) that is enclosed within an electrically nonconductive housing 24. The frame 22 is formed of rigid materials such as welded steel tubing, and includes a foot section 26 that is configured to rest against the support surface 18 outwardly adjacent the upright tub wall 16. When installed, the frame 22 and housing 24 will rest on the support surface 18 and abut the outside surface of the tub wall 16.

The bottom surface of the frame and housing is flat to rest flush against the support surface 18. Thus the weight of the lift and at least part of the patient's weight will be transmitted through the frame and housing to the support surface 18.

Figure 3:
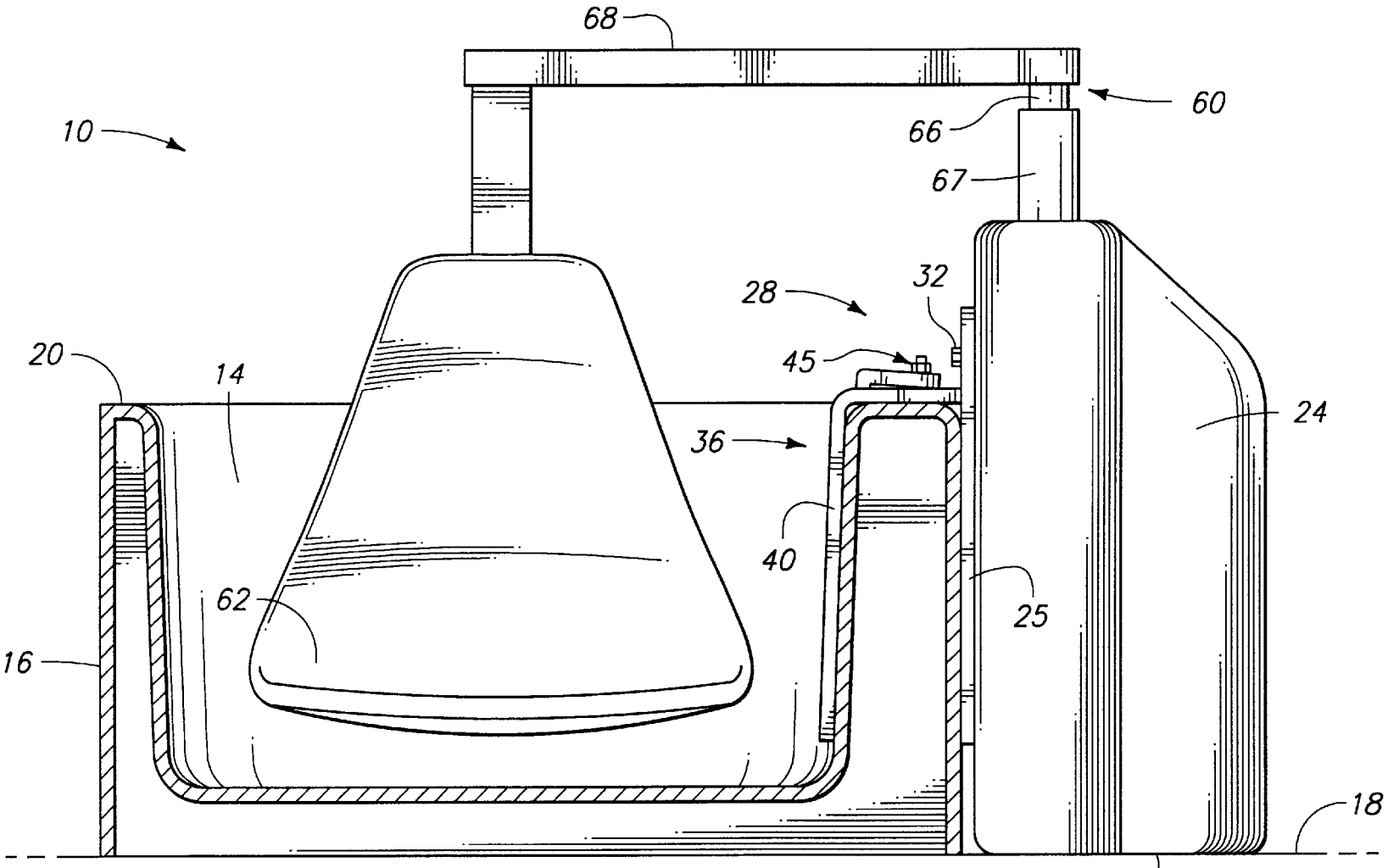
FIG. 3 is a transverse section through the bathtub, showing the preferred lift with the chair in a lowered position within the tub basin.

The frame 22 extends upwardly to adjustment members 28 that are provided on the frame to enable elevational adjustment of a clamp member 36 (described below) to accommodate bathtubs having different height measurements from the support surface 18 to the top ledge 20. The adjustment is comprised of slotted flanges 30 on the top ends of the frame 22 (FIG. 3) that receive nut and bolt combinations 32 which secure the clamp member to the frame. The nut and bolt combinations 32 can be loosened to allow sliding adjustment of the clamp member along the flanges, and then re-tightened with the clamp member at a selected height in relation to the support surface.

The clamp member 36 is connected to the slotted flanges 30 of the frame 22 by way of the nut and bolt combinations 32. In a preferred form, the clamp member 36 is shaped to fit over the wall of the bathtub, with an outer leg section 25 conforming to the outside wall of the tub, a top section 38 conforming to the top ledge surface of the tub, and an inward leg section, including a pair of downwardly extending clamp arms 40 that extend into and conform to the inside wall of the tub.

The outer leg section 25 is secured by the nut and bolt combinations 32 to the frame 22 and housing. The leg section serves to brace the frame and housing against the tub and provides stability to the structure. The top section 38 is rigidly secured or is integral with the outer leg section 25, and extends horizontally over the top ledge surface 20 of the bathtub to meet the downwardly extending clamp arms. At least one and preferably two of the downwardly extending clamp arms 40 are mounted to a part of the horizontal frame section 38, for pivotal movement thereon between an open position (FIG. 7) and a closed position (FIG. 8). Pivotal movement is enabled by a hinge 42 that extends along the frame section 38 and defines the pivot axis of the arms 40.

Figure 4:
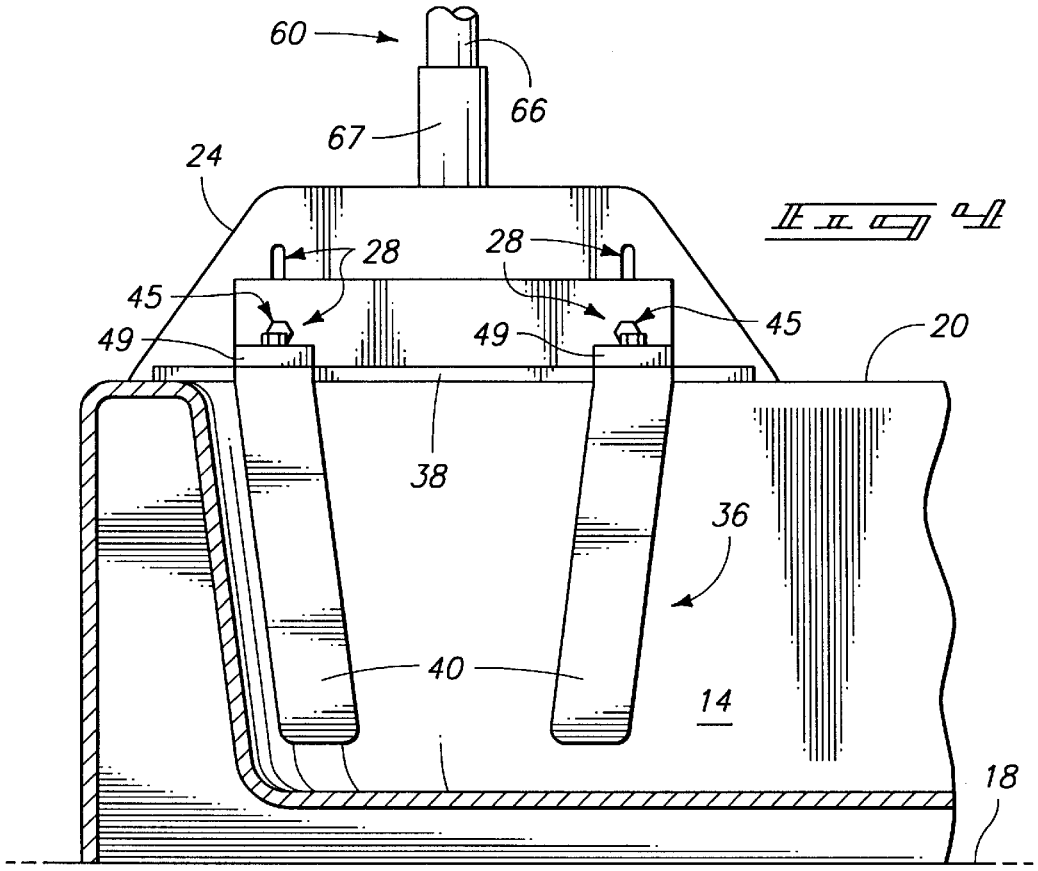
FIG. 4 is a fragmented side elevational view as seen from inside the tub basin and showing clamp arms of the present lift.
Figure 5:
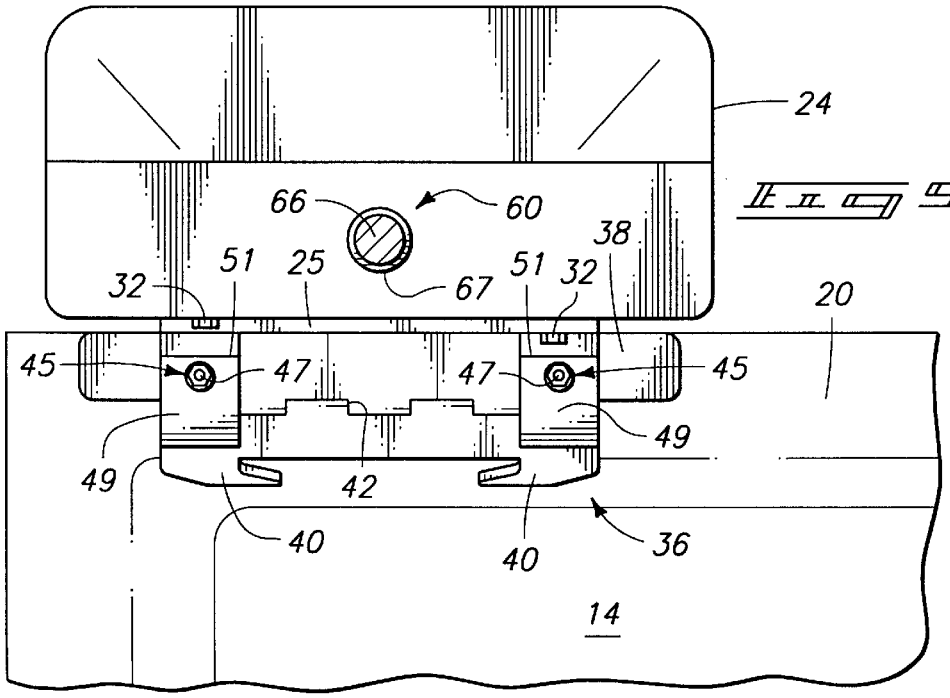
FIG. 5 is a fragmented top plan view.

It is noted that the clamp arms 40 are angularly oriented as shown in FIG. 4. The angular nature of the arms allows the lift to be positioned closely adjacent the head end of the bathtub. Both arms are similarly angulated to enable use of the lift from either right or left hand sides of a tub.

A clamp actuator 45 is provided on the preferred clamp member, and is operable to forcibly close the clamp member 36, thereby clamping the tub wall between the clamp member 36 and frame 22. Operation of the actuator 45 is best understood with reference to FIGS. 7 and 8.

In a preferred form, the clamp actuator 45 includes at least one and preferably a pair of studs 47 on the horizontal frame section 38. Each of the studs 47 project upwardly through a lever arm 49. The lever arms are movably positioned on the studs, each having one end 51 pivotably engaging the horizontal frame section 38 and a remaining end 53 engaging the horizontal frame part 38. The hinge 42 is positioned between the studs and the remaining lever ends 53.

Nuts 55 threadably engage the studs and operate against the lever arm whereby selective rotation of the nut will apply selective pressure against the lever arm to forcibly pivot the clamp arms 40 toward the closed position. Thus the clamp arms may be moved by turning the nuts 55 between the open position (FIG. 7), allowing mounting and removal of the lift to a bathtub, and the closed position (FIG. 8), securely clamping the lift to the tub wall 16.

It is noted that the clamping forces are combined with support provided by the frame resting against the support surface 18. Structural stability may also be added by a fastener arrangement 58 that may be attached to the frame at the foot section 26 to secure the lift 10 with respect to the support surface 18. The fastener arrangement 58 may be of a conventional variety in which a threaded socket is secured to the support surface 18 and a hand screw is provided at the bottom of the frame to threadably engage the socket and selectively clamp the frame against movement on the surface.

Figure 2:
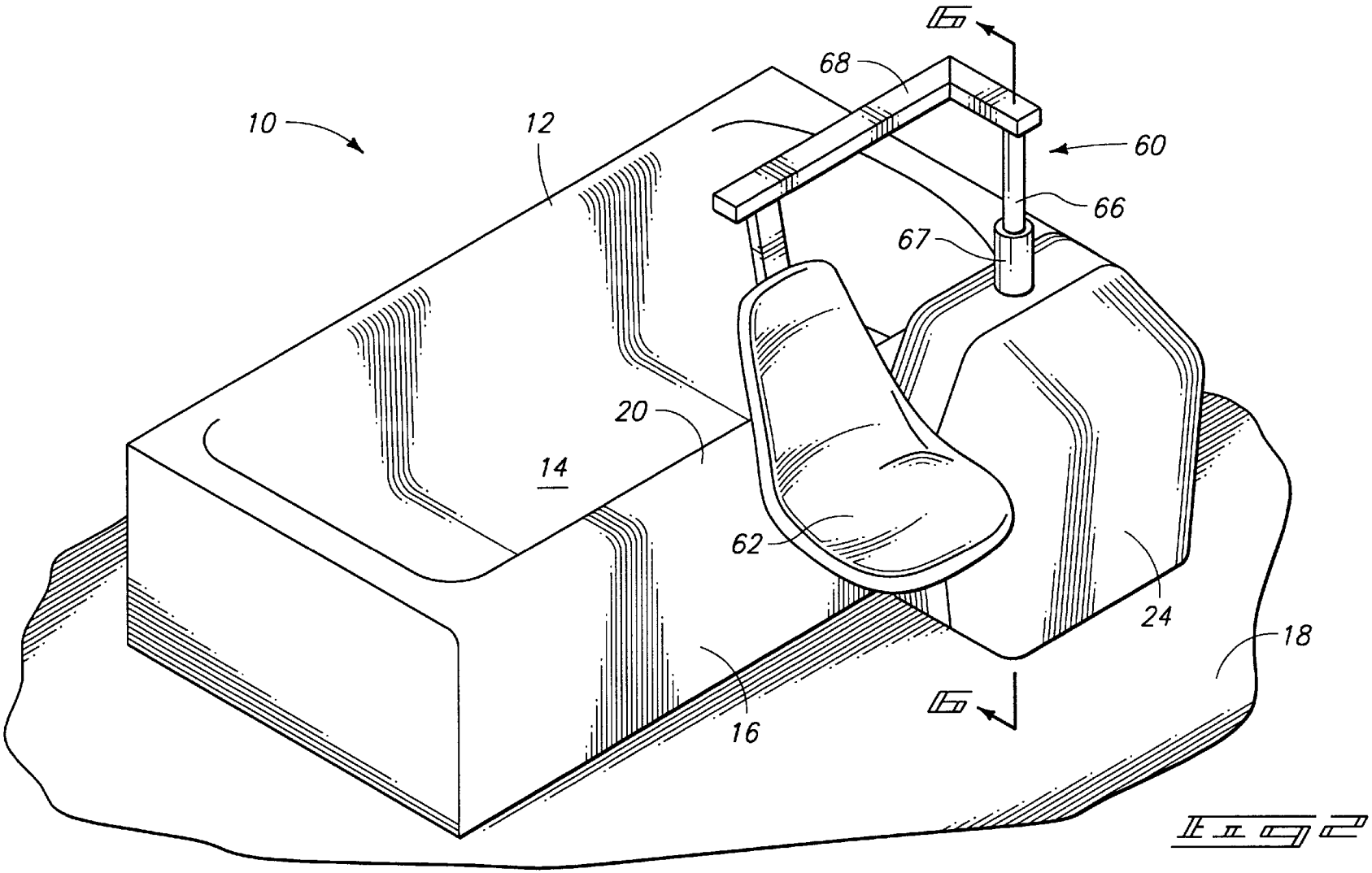
FIG. 2 is a perspective view of the preferred portable bathtub lift with the chair in place alongside the conventional bathtub.

A lift mechanism 60 is provided on the frame 22, including a patient support 62. The lift mechanism 60 is powered to move the patient support surface elevationally between an elevated position where the patient support 62 is situated above the bathtub ledge 20 (FIG. 1), and a lowered position (FIG. 3) in which the support 62 is at an elevation just above the tub bottom. The patient support surface is also pivotable about a substantially vertical axis between a position outward of the bathtub (FIG. 2), and a position over the tub basin 14 (FIG. 1).

The lift mechanism preferably includes a conventional linear actuator 64 (FIG. 6), of the type including an upright screw jack shaft 66 driven by a gear reducer and electric motor that is secured to the frame 22. Such mechanisms are commonly known and are commercially available. The shaft 66 is rotatable about a vertical axis and is stabilized in relation to the frame by a bushing 67. The preferred shaft 66 is freely rotatable, to allow a patient sitting on the support 62 (or an attendant) to swing the support between the positions shown in FIGS. 1 and 2.

The top end of the screw jack shaft 66 is provided with a cantilevered arm 68 (FIGS. 1, 2) that extends laterally of the shaft. The remote end of the arm 68 is down turned and extends downwardly to mount the patient support 62, which may be provided in the form of a chair.

The preferred lift mechanism is electrically powered, most preferably by way of a battery 70 that is rechargeable by provision of a battery charger 72. The battery charger is selected to deliver a minimal charging current to the battery for safety purposes, but will charge the battery to a sufficient energy level to operate the lift. The electrical charging system is configured for connection to common household current through a conventional plug-in.

From the above description, operation of the invention may now be easily understood.

Prior to operation, the present lift is installed adjacent to a bathtub. This procedure is accomplished without requiring any alteration of the bathtub.

Firstly, the socket member for the fastener arrangement is secured to the support surface in position to receive the associated hand screw.

The installer will also loosen the bolt and nut 32 combinations to allow elevational adjustment of the clamp member 36. The nuts 55 are also turned to allow the clamp to shift to the open position. Now the lift is lowered into position so the foot section 26 comes to rest on the support surface 18 and the clamp member 36 loosely receives the adjacent wall of the tub.

As the unit is lowered, the adjustment members 28 will allow the foot section to move into contact with the support surface. The hand screw is now threadably engaged with the previously placed socket and tightened to secure the frame in position on the support. With the foot section resting on the support surface, the clamp member 36 is shifted downwardly relative to the frame (by provision of the slotted flanges 30) until the horizontal frame part 38 comes to rest against the ledge 20 of the bathtub wall, and the clamp arms 40 extend downwardly into the tub basin. The bolt and nut combinations 32 are now tightened to secure the frame to the clamp member 36.

Figure 7:
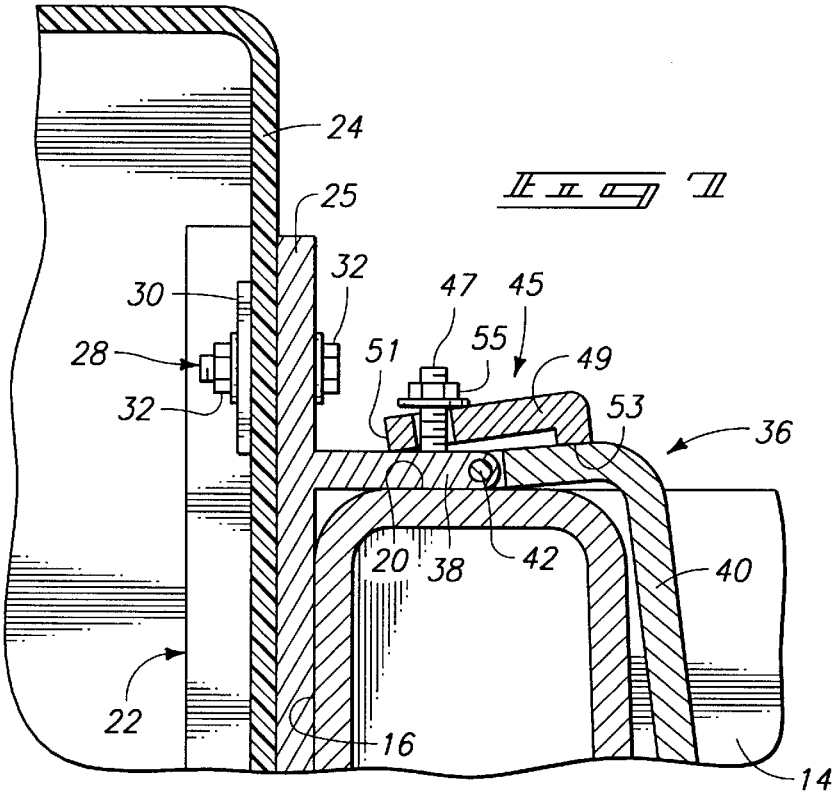
FIG. 7 is an enlarged, fragmented sectional view taken through a preferred clamp mechanism for securing the lift to a bathtub with the clamp shown in a released, open position.
Figure 8:
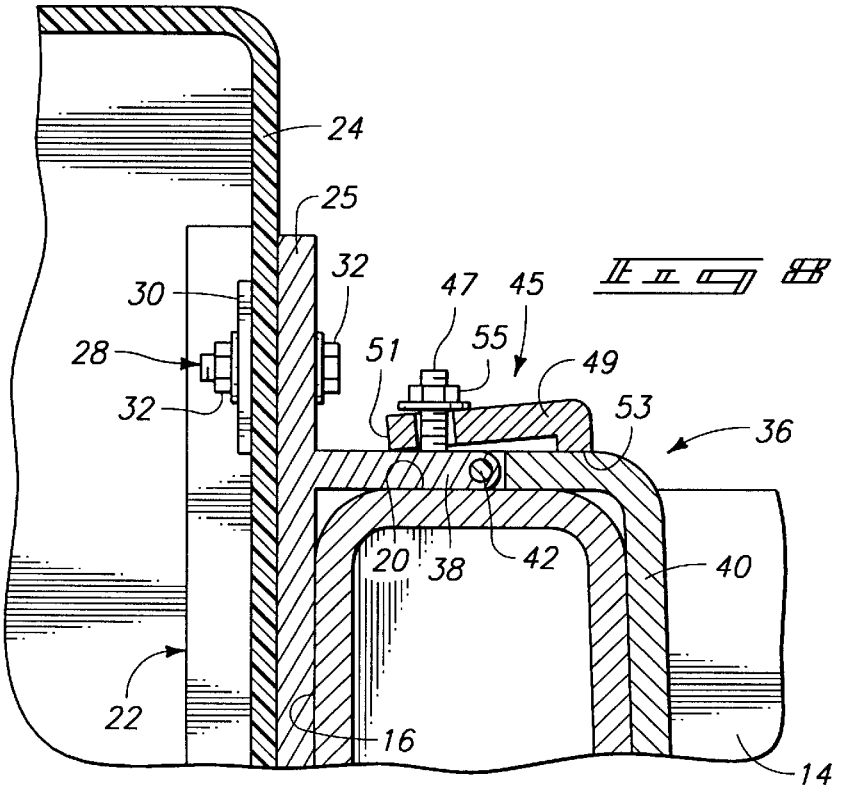
FIG. 8 is a view similar to FIG. 7 only showing the clamp mechanism in a closed, clamping position wherein the wall of the bathtub is securely gripped.

The final step in securing the lift in place includes tightening the nuts 55 (FIGS. 7, 8). This causes the clamp arms 40 to swing against the inside surface of the tub wall, securely clamping the tub wall between the frame and clamp arms.

The battery 70 must be charged prior to operation. This is done simply by plugging the electrical plug-in into a convenient electrical outlet socket, and waiting until the battery comes to a full charge condition. When the battery becomes charged, the plug may be removed from contact with household current, and the lift is ready for use.

In use, the patient support is shifted to the elevated position outwardly adjacent to the bathtub. The patient then shifts his or her weight onto the support 62 and swings the support from the starting position alongside the bathtub to a position over the tub basin. During this movement the patient and support 62 move about the axis defined by the screw jack shaft 66. Legs are lifted over the tub wall 16 by the patient or by an assistant. Now the lift mechanism may be actuated to lower the patient into the tub basin.

When bathing is finished, the lift mechanism is again operated to lift the patient upwardly until the support is above the tub ledge 20. The patient or attendant may then swing the support outwardly over the tub wall to the initial starting position where the patient may shift his or her weight from the support to another support such as a wheel chair.

When it becomes desirable to move the present lift to another location, the above installation steps are simply reversed to release the lift from the bathtub and support surface. The entire unit can now be moved to another location and be re-installed.

It is noted that mounting the present lift does not require support structure other than the bathtub wall and the adjacent support surface. Further, the present lift does not require that holes be bored in the bathtub for mounting purposes. Thus the present lift presents the advantage of portability without requiring defacement of the bathtub and only minor alteration of the support surface (placement of the socket for the fastener arrangement 58).

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. A portable bathtub lift mountable to a bathtub including a tub surround formed by a substantially upright wall positioned on a support surface and terminating at an elevated top ledge surface, the lift comprising:

a frame including a foot section configured to rest against the support surface outwardly adjacent the upright tub wall;

a clamp member on the frame configured to extend over the top ledge surface of the bathtub wall and downwardly into the tub to clamp the frame to the upright tub wall;

wherein the clamp member is comprised of:

a substantially horizontal frame section configured to extend over the top ledge surface of the bathtub;

a downwardly extending clamp arm mounted to the horizontal frame for pivotal movement thereon between an open position and a closed position;

a clamp actuator on the clamp member operable to forcibly move the clamp member toward a closed position, to facilitate clamping the tub wall;

wherein the clamp actuator is comprised of:

a stud on the horizontal frame section;

a lever arm movably positioned on the stud and having one end pivotably engaging the horizontal frame section and a remaining end engaging the clamp arm;

a nut threadably engaging the stud and engaging the lever arm whereby selective rotation of the nut will apply selective pressure against the lever arm to forcibly pivot the clamp arm toward the closed position;

a lift mechanism on the frame including a patient support surface that is powered to move the patient support surface elevationally; and wherein the patient support surface is pivotable about a substantially vertical axis between a position outward of the tub and a position over the tub.

2. A portable bathtub lift as defined by claim 1 wherein the lift mechanism is battery operated.

3. A portable bathtub lift as defined by claim 1 wherein the foot section includes a releasable fastener arrangement operable to releasably secure the frame to the support surface.

4. A portable bathtub lift as defined by claim 1 further comprising adjustment members on the frame operable to adjustably position the clamp member elevationally with respect to the frame.

5. A portable bathtub lift as defined by claim 1 wherein the lift mechanism is driven by an electric motor electrically connected to a battery, and further comprising a battery charger connected to the battery.

6. A portable bathtub lift as defined by claim 1 wherein the lift mechanism is comprised of a linear actuator.

7. A portable bathtub lift as defined by claim 1 wherein the lift mechanism is comprised of a linear actuator including an electric motor drivingly connected to a screw jack, and a battery electrically connected to the electric motor.

* * * * *